United States Patent [19]

Kilbride

[11] Patent Number: 4,880,394

[45] Date of Patent: Nov. 14, 1989

[54] HEATING PANEL ASSEMBLY

[75] Inventor: Cuthbert J. Kilbride, Fredricton, Canada

[73] Assignee: Canray Incorporated, Oromocto, Canada

[21] Appl. No.: 288,452

[22] Filed: Dec. 22, 1988

[30] Foreign Application Priority Data

Feb. 11, 1988 [CA] Canada ..... 558674

[51] Int. Cl.[4] ..... H01R 4/24

[52] U.S. Cl. ..... 439/404

[58] Field of Search ..... 439/389–426

[56] References Cited

U.S. PATENT DOCUMENTS 4,693,533 9/1987 Szczesny et al. ..... 439/404

4,697,862 10/1987 Hasircoglu ..... 439/404

*Primary Examiner*—Joseph H. McGlynn

*Attorney, Agent, or Firm*—Bachman & LaPointe

[57] ABSTRACT

A heating panel assembly ready for mounting in a ceiling frame work comprises a heating panel with an electrical connector mounted along an edge portion of the panel; the electrical connector has retaining channels therein with insulation piercing elements of metal fixed in the channels, electrically connected to leads extending into the body of the connector from the panel; in use the insulated conductors are introduced into the channels, and the insulation is pierced by the piercing elements to electrically connect each piercing element of a channel with the conductive core of the insulated conductor in such channel; in this way electrical connection is readily effected between the power line and the heating panel in a simple operation; the body of the connector suitably has a lid which can be opened to permit inspection of the electrical connection.

25 Claims, 4 Drawing Sheets

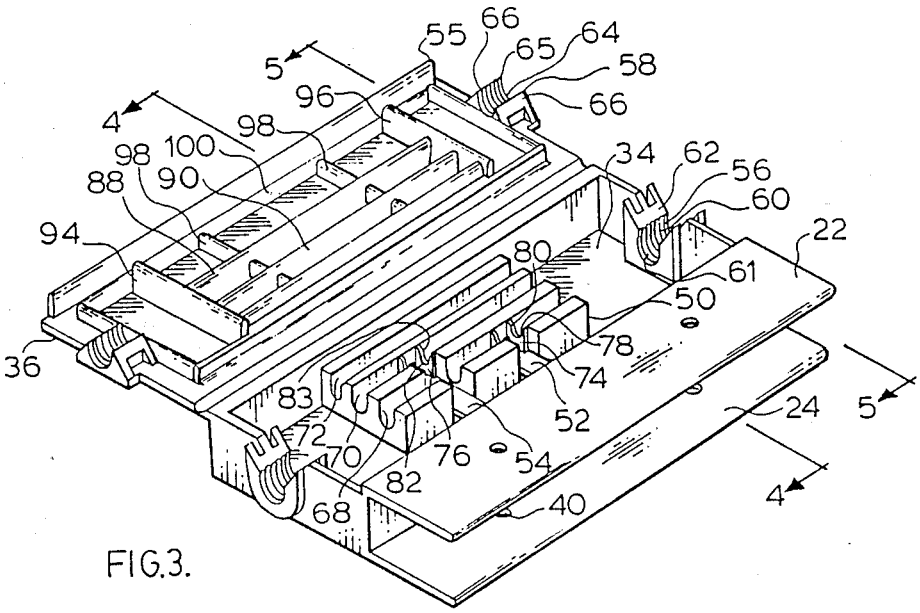
FIG.3.
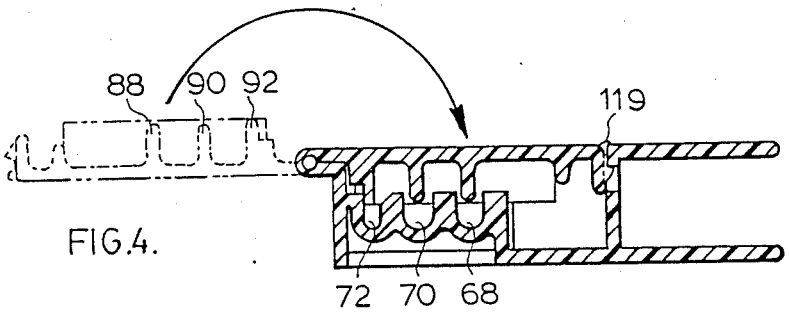
FIG.4.
FIG.5.
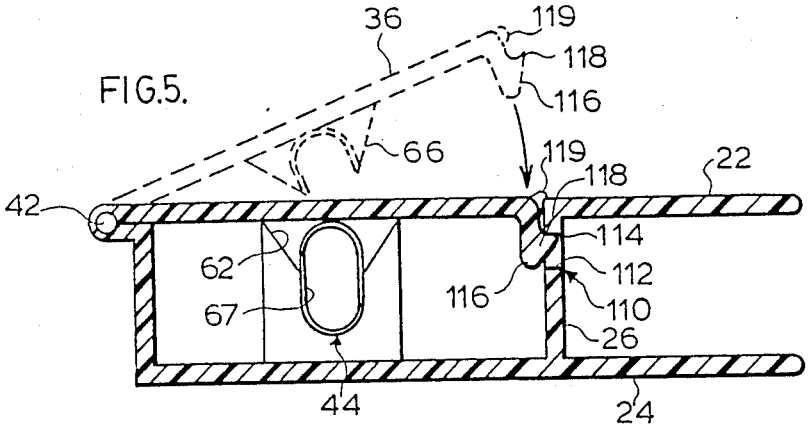

HEATING PANEL ASSEMBLY

BACKGROUND OF THE INVENTION (i) Field of the Invention

This invention relates to a heating panel assembly and an electrical connector as a component of such assembly, more especially a self-stripping connector.

(ii) Description of the Prior Art

Electrical heating ceiling panels are known having a heating wire embedded in a ceiling panel. The panels radiate the heat developed by the heating wire and provide a very cost effective method of heating a room. The radiant heating panels convert electrical energy to heat without the use of noisy pumps, blowers or furnaces and the accompanying dust, smell and maintenance costs.

Typically such panels comprise gypsum board panels about 0.5 inches in thickness, having low temperature nichrome heating wires embedded therein.

The heating panels are generally suspended on straps which are secured across the length of the joists or rafters to hold the heating panels therebetween. After installation of the heating panels, a normal ceiling, for example, of sheet rock or plaster board is applied to and supported from the joists by mechanical fasteners.

During installation of the panels it is necessary to effect an electrical connection between a main power line and the heating wire of the panel. In particular, a pair of source leads which are electrically connected to the heating wire extend from one side edge of the panel and an electrical connection is formed between the leads and the main power line; and a plurality of the panels are connected in this way, in parallel.

U.S. Pat. No. 3,751,630, J. L. Brasky, issued Aug. 7, 1973, describes an arrangement for effecting such electrical connection employing double-ended sleeve type connectors. This arrangement requires the formation of grooves or recesses in the side edge of the panel, interconnected by apertures. The electrical connection is formed by crimping at the double-ended sleeve and the connection is then covered with a heat shrinkable insulating tube or with gypsum grout or other insulating material.

Canadian Pat. No. 1,198,138, J. L. Brasky, issued Dec. 17, 1985, describes another arrangement for forming the electrical connection in which self-stripping connector elements are employed to strip the plastic insulation from the insulated conductor of the power lines and simultaneously form an electrical connection between the exposed conductors and the source leads. These connector elements are then encapsulated with a U-shaped closure member having parallel leg portions which slidably engage the surfaces of the panel. The electrical connections are then insulated, for example, by introducing an air-hardenable insulating grout into the closure member.

The latter technique is employed commercially but has disadvantages. In particular, the several steps of assembly of the parts is carried out by the electrician on the site of installation, i.e., the ceiling; the electrician is required to carry out tasks outside his normal practice, for example, the application of the grout; and the use of the grout is messy. These disadvantages have resulted in reluctance by some contractors to employ the heating panels for installation in new buildings. A further disadvantage is that after the application of the grout the electrical connection cannot be inspected by municipal and government personnel employed to make such inspections.

A further disadvantage of the prior structures is that electricians sometimes replace the electrical connector with one not approved for the particular application.

SUMMARY OF THE INVENTION

It is an object of the invention to provide a heating panel assembly whereby the electrical connection with the main power line can be more readily effected by the electrician in a simple operation; which does not require use of grout or similar materials, in which the completed electrical connection can be readily inspected, and in which the electrical connector is an integral part of the assembly.

It is a further object of the invention to provide an electrical connector for such assembly.

A still further object of the invention is to provide a method of installing heating panels.

In accordance with the invention there is provided an electrical connector for an electrical heating panel comprising: an electrically insulative housing, panel engaging means extending outwardly from said housing, entry and exit ports in said housing for passage of a multiple conductor power line therethrough; retaining and piercing means in said housing to electrically isolate individual insulated conductors of the power line in a path between said entry and exit ports, and including electrically conductive piercing members adapted to pierce the insulation of the isolated conductors to effect electrical contact between respective piercing members and respective conductors, said piercing members being electrically isolated from each other, and inlet means in said housing for passage of leads from a heating panel for electrical connection with the piercing members.

In accordance with another aspect of the invention there is provided a heating panel assembly comprising: a generally planar panel having opposed planar major surfaces, bounded by an edge surface, an electrical resistance heating wire embedded within said panel between said major surfaces and first and second leads electrically connected with said heating wire and extending from said edge surface, an electrical connector comprising an electrically insulative housing and panel engaging means extending outwardly from said housing, said connector being mounted to said panel at said engaging means, inlet means in said housing, said leads of said panel projecting through said inlet means into said housing, entry and exit ports in said housing for passage of a multiple conductor power line therethrough, retaining and piercing means in said housing to electrically isolate individual insulated conductors of the power line in a path between said entry and exit ports, and including electrically conductive piercing members adapted to pierce the insulation of the isolated conductors to effect electrical contact between respective piercing members and conductors, said piercing members being electrically isolated from each other, and said first and second leads being electrically connected to said piercing members.

In still another aspect of the invention there is provided a method of installing a heating panel comprising: providing a heating panel assembly as defined hereinabove, removing an outer sheath of a multiple conductor power line along a short length of the line to expose individual insulated conductors, disposing the short length within said housing between said ports and guiding said individual insulated conductors into said retaining and piercing means, to isolate said individual insulated conductors, and piercing the insulation of the insulated conductors to effect an electrical connection between the conductive cores of said isolated conductors and said first and second electrical connection elements, and including. securing said assembly in a ceiling framework.

BRIEF DESCRIPTION OF THE DRAWINGS

The invention will now be described with reference to the accompanying drawings, wherein:

FIG. 3 is a perspective view of the electrical connector of the assembly of FIG. 1 with the lid open to reveal the interior, FIG. 4 is an end elevation partially in section on line 4—4 of FIG. 3, showing open and closed configurations, FIG. 5 is an end elevation in cross-section on line 5—5 of FIG. 3 illustrating the closure of the lid.

DESCRIPTION OF PREFERRED EMBODIMENTS WITH REFERENCE TO THE DRAWINGS

Figure 1:
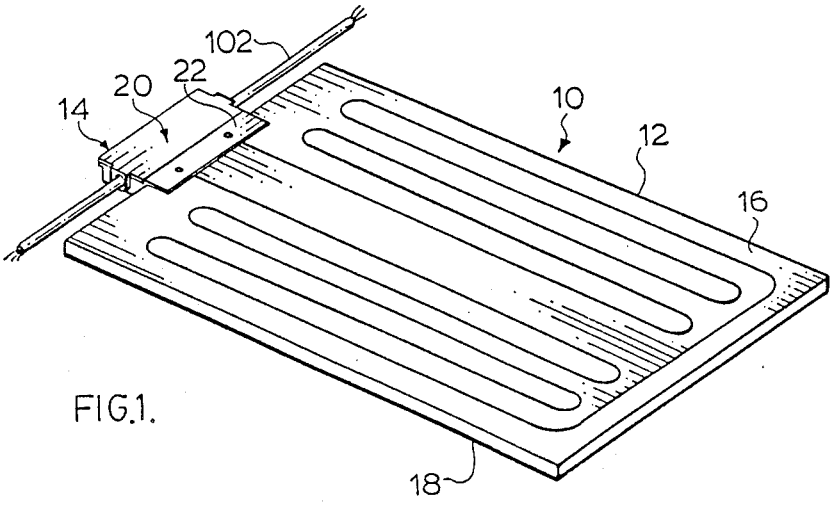
FIG. 1 is a perspective view of a heating panel assembly of the invention.
Figure 2:
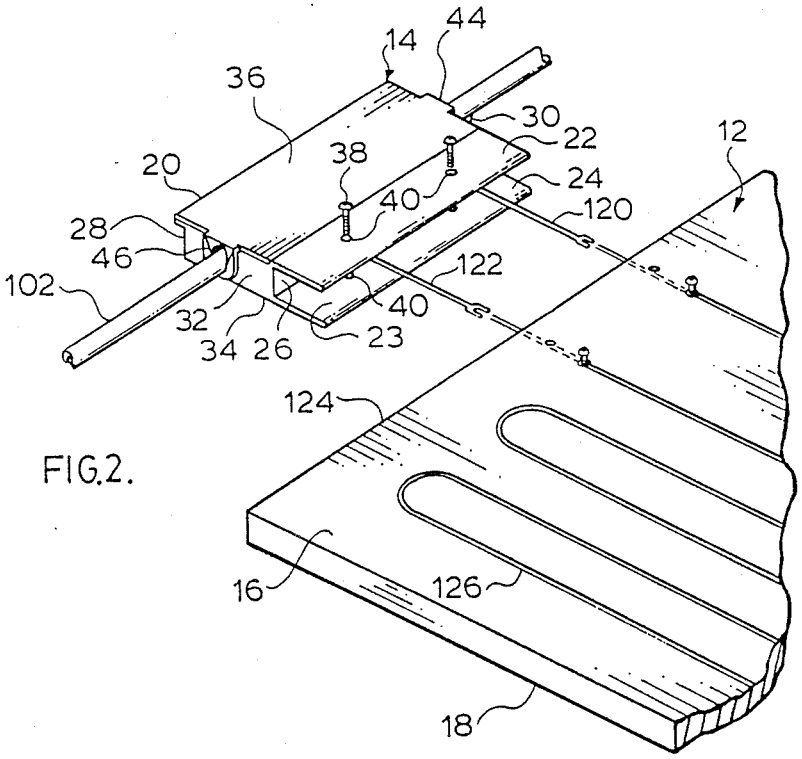
FIG. 2 is an exploded view of part of the assembly of FIG. 1.

With further reference to FIG. 1, a heating assembly 10 includes a heating panel 12 on which is mounted an electrical connector 14. A power line 102 is shown connected to assembly 10.

Heating panel 12 includes a panel upper surface 16 and a panel lower surface 18.

Electrical connector 14 includes a body of insulative material 20; a pair of generally parallel spaced apart flanges 22 and 24 extend outwardly from body 20.

Body 20 includes an inner side wall 26, an outer side wall 28, an entry end wall 30, an exit end wall 32, a floor 34 and a cover or lid 36.

A slot 23 is defined between flanges 22 and 24, and inner side wall 26.

A first pair of orifices 40 is formed in flange 22 and a similar pair of orifices 40 is formed in flange 24, the orifices 40 of flanges 22 and 24 being in opposed relationship.

Figure 7:
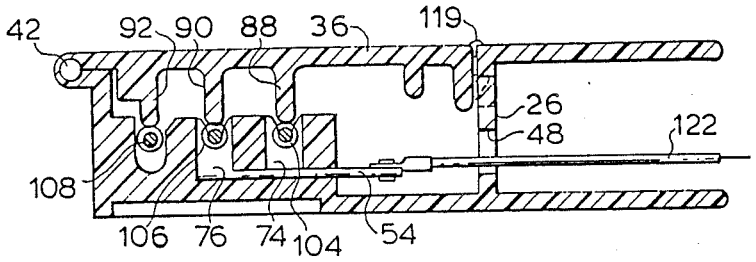
FIG. 7 is an end elevation in cross-section of the heating panel assembly (but with the panel not shown) illustrating the electrical connection between the power line and the panel.

Inner side wall 26 includes a pair of lead outlets 48 therethrough (see FIG. 7) and heating panel 12 includes electrical leads 120 and 122 extending from a side edge 124, which leads 120 and 122 are in electrical connection with a heating wire 126 embedded within panel 12.

Body 20 includes an entry port 44 in entry end wall 30 and an exit port 46 in exit end wall 32, entry and exit ports 44 and 46 being in generally opposed relationship.

In assembling electrical connector 14 to heating panel 12, leads 120 and 122 are fed through lead outlets 48 and panel 12 is slid into slot 23 between flanges 22 and 24 so that side edge 124 is brought into abutting relationship with inner side wall 26. Flange 22 engages panel upper surface 16 and flange 24 engages panel lower surface 18. Heating panel 12 and electrical connector 14 are then secured together by screws 38 extending through orifices 40, or by similar attachment means.

Figure 6:
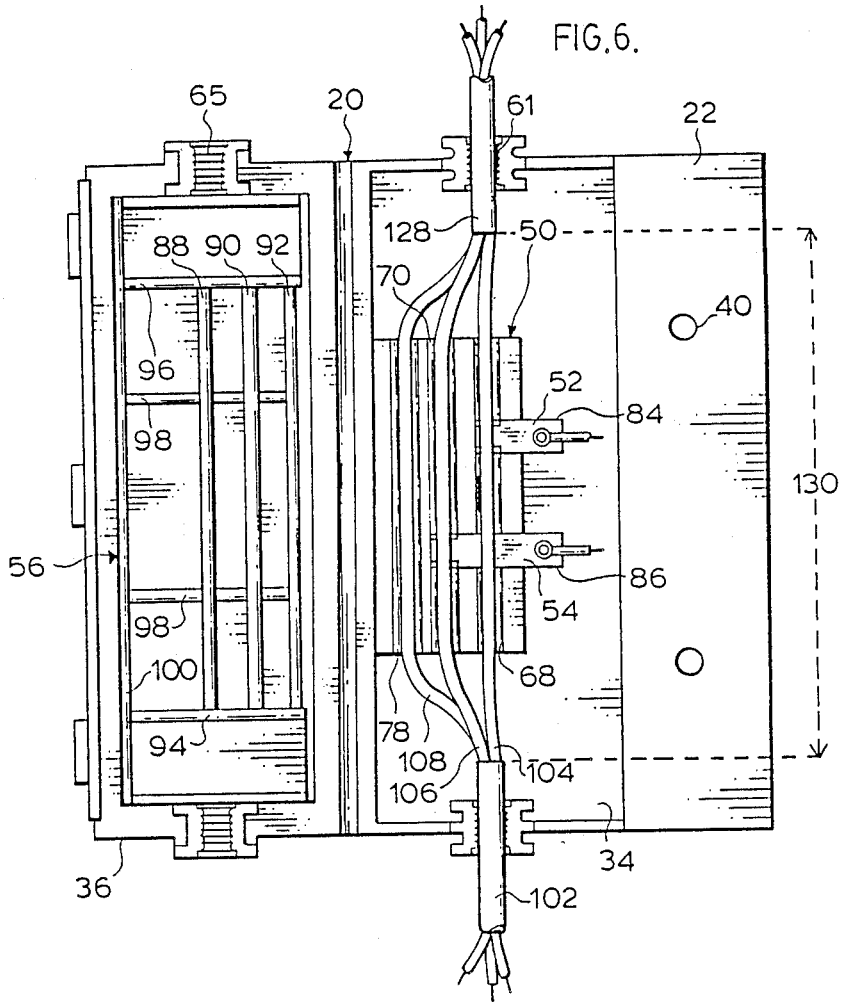
FIG. 6 is a plan view of the connector of FIG. 3 with the power line disposed so to extend therethrough and the lid open to reveal the interior.

With further reference to FIGS. 3 and 6, electrical connector 14 is shown with lid 36 opened about hinge 42.

A channel member 50 extends from floor 34 and electrical connection plates 52 and 54 extend from channel member 50.

A framework 55 is formed on the interior face of lid 36.

A lower arch 56 is formed in end wall 30 and an upper arch 58 is formed in lid 36. Lower arch 56 includes an arcuate passage 60 and bevelled walls 62. Upper arch 58 includes an arcuate passage 64 and bevelled walls 66. When lid 36 is in the closed configuration (see FIG. 5) bevelled walls 62 and 66 mate whereby arcuate passages 60 and 64 define entry port 44. The arcuate passages 60 and 64 have arcuate gripping surfaces 61 and 65, respectively, defined by arcuately extending ridges and grooves, the gripping surfaces 61 and 65 forming a generally circular gripping surface 67 of port 44. The gripping surface 67 serves to securely grip the power line 102.

Exit port 46 is of identical structure.

Channel member 50 includes an outer power channel 68, an intermediate power channel 70 and an outer ground channel 72.

A metal tongue 74 is fixedly mounted in outer power channel 68 and a metal tongue 76 is fixedly mounted in intermediate power channel 70.

A notch 78 having an insulation piercing edge 80 is defined in metal tongue 74 and a similar notch 82 having an insulation piercing edge 83 is defined in metal tongue 76.

A track 84 extends into channel member 50 to outer power channel 68 and a track 86 extends into channel member 50 to intermediate power channel 70.

The electrical connection plate 52 is disposed in track 84 and is in electrical connection with metal tongue 74; similarly, electrical connection plate 54 is disposed in track 86 and is in electrical connection with metal tongue 76.

Framework 55 includes ribs 88, 90 and 92 in generally parallel spaced apart relationship; ribs 88, and 92 extend between generally parallel, spaced apart end struts 94 and 96.

The end struts 94 and 96 extent between opposed sides of a peripheral frame wall 100.

Inner struts 98 extend between rib 88 and frame wall 100 and between ribs 88 and 90 and ribs 90 and 92.

End struts 94 and 96 are of greater height than inner struts 98 and frame wall 100.

With particular reference to FIG. 6, there is shown a power line 102 trained through body 20.

Power line 102 has a multi-layer outer sheath 128 surrounding insulated conductors 104 and 106 a ground 108. As viewed in FIG. 6 a short section 130 of power line 102 is disposed in the body 20 and the sheath 128 has been removed from this section 130 to expose the insulated conductors 104 and 106 and ground 108.

With further reference to FIG. 5, inner side wall 26 has an elongate catch 110 defined by an elongate slot 112 having a bevelled roof 114.

An outer edge of lid 36 remote from hinge 42 includes a latch 116 having a deformable tooth 118 and a resilient lip 119.

On closure of lid 36, tooth 118 is deformed against the interior face of inner side wall 26 as lid 36 is moved downwardly, until tooth 118 meets slot 112 and is free to expand into engagement with bevelled roof 114. The engagement of tooth 118 with roof 114 serves to secure lid 36 in the closed configuration. In the closed configuration resilient lip 119 is squeezed against the interior face of inner side wall 26 to form a tight seal.

On application of an upward force on lid 36, tooth 118 is deformed initially against the inner edge of bevelled roof 14 and then against the interior face of inner side wall 26 as lid 36 is raised.

Heating panel assembly 10 is provided as a unit by the manufacturer ready to mount in a ceiling frame work. In this manufactured assembly 10, lead 120 is soldered or otherwise electrically connected to electrical connection plate 52 and lead 122 is similarly electrically connected to electrical connection plate 54.

The electrician raises lid 36 about hinge 42 to open body 20. The electrician removes the outer sheath 128 of power line 102 to expose the insulated conductors 104 and 106 and the ground 108 along a short section 130 of the power line 102 to be housed within body 20.

Power line 102 is trained in lower arch 56 of entry port 44 and the corresponding lower arch of the exit port 46 with section 130 extending between ports 44 and 46. Insulated conductor 104 is trained or disposed along outer power channel 68; insulated conductor 106 is trained or disposed along intermediate power channel 70; and ground 108 is trained or disposed along outer ground channel 72, (FIG. 6).

The electrician closes lid 36 about hinge 42 to the closed configuration in which latch 116 is engaged in catch 110. During the closure of lid 36, ribs 88 and 90 depressingly urge insulated conductors 104 and 106, respectively into channels 68 and 70, respectively, and rib 92 depresses ground 108 into channel 72. In this way conductors 104 and 106 and ground 108 are securely located in the respective channels 68, 70 and 72 and are retained therein (see FIGS. 4 and 7).

During the depressing of insulated conductor 104 into channel 68, conductor 104 is forced into notch 78 of metal tongue 74, where the insulation of conductor 104 is pierced by insulating piercing edge 80 to provide electrical connection between the conductive core of conductor 104 and metal tongue 74 and hence with electrical connection plate 52.

Similarly insulating conductor 106 is forced by rib 90 into notch 82 of metal tongue 76 which results in piercing of the insulation of conductor 106 by piercing edge 83 to provide electrical contact between the conductive core of conductor 106 and metal tongue 76 and hence with electrical connection plate 54.

In the closed configuration the generally circular gripping surface 67 of port 44 and the similar gripping surface of port 46 grippingly engage the outer sheath 128 of power line 102.

The body 20 including the channel member 50 and the frame work 55 are all of electrically insulative material, for example, they may be molded of an insulative plastic.

The electrical connection plates 52 and 54 are insulatively spaced apart in a non-electrically contacting relationship, and in addition are conveniently spaced a sufficient distance apart to avoid the possibility of arching.

The frame wall 100 and in addition the end struts 94 and 96 which are of greater height form a secondary barrier or shield serving to isolate the electrical connections between the conductor 104 and metal tongue 74 and conductor 106 and metal tongue 74, in addition to the insulation provided by the side walls 26 and 28 and end walls 30 and 32.

It will be evident that the electrician can readily complete the electrical connections with a minimum of fuss and without the need to use grouting materials.

In addition the lid 36 although secure in the closed configuration can be readily opened about hinge 42 to permit inspection of the electrical connections by municipal inspectors or the like.

Conveniently the body 20 is dimensioned so that the outer faces of floor 34 and lid 36 are flush with the outer faces of flanges 22 and 24 to provide a neat appearance.

The assembly 10 can be manufactured as a unit at a manufacturing plant and this considerably simplifies the installation at the site of use and reduces the labour at the site of use.

The tongues 74 and 76 may in particular be double tongues as shown in FIGS. 3 and 6 each having an insulation piercing edge to ensure electrical connection between conductors 104 and 106 with plates 52 and 54 respectively, however, single tongues may also be used without departing from the invention.

Figure 8:
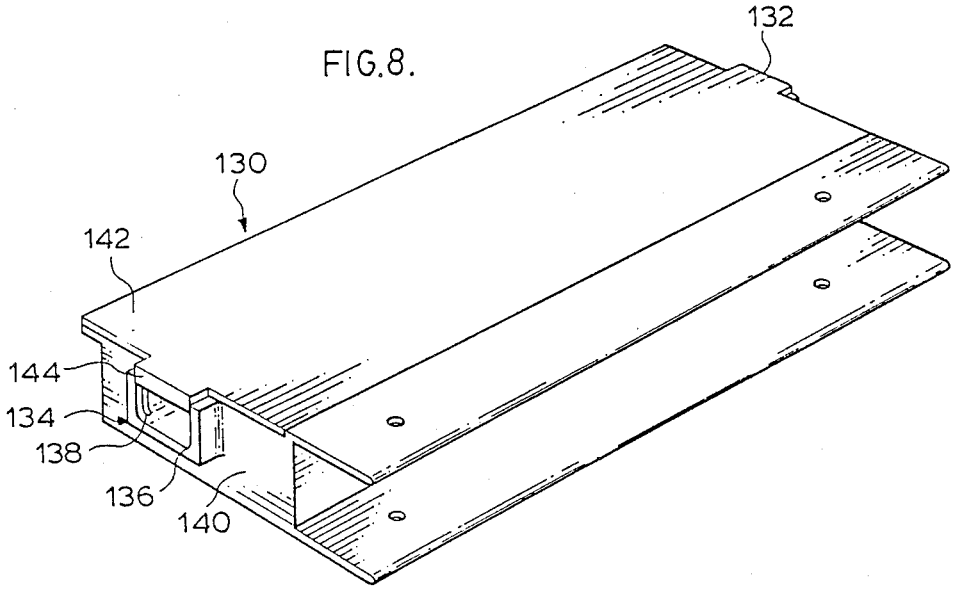
FIG. 8 is a perspective view of the connector in a different embodiment.

With further reference to FIG. 8, an electrical connector 130 differs from electrical connector 14 in the design of the entry and exit ports.

Electrical connector 130 has an entry port 132 and an exit port 134.

Exit port 134 includes a projecting arch 136 having a gripping surface 138; arch 136 extends from an exit end wall 140.

A cover or lid 142 of connector 130 includes a projection 144 of greater thickness than lid 142, which is adapted to be matingly received in arch 136 when lid 142 is closed. In this way projection 144 urges a cable received in connector 130 into arch 136 and into engagement with gripping surface 134.

I claim:

1. An electrical connector for an electrical heating panel comprising:

an electrically insulative housing, panel engaging means extending outwardly from said housing, entry and exit ports in said housing for passage of a multiple conductor power line therethrough, retaining and piercing means in said housing to electrically isolate individual insulated conductors of the power line in a path between said entry and exit ports, and including electrically conductive piercing members adapted to pierce the insulation of the isolated conductors to effect electrical contact between respective piercing members and respective conductors, said piercing members being electrically isolated from each other, and inlet means in said housing for passage of leads from a heating panel for electrical connection with the piercing members.

2. A connector according to claim 1, further including electrical connector elements in said housing, said elements being electrically insulated from each other, each of said elements being electrically connected with one of said piercing members.

3. A connector according to claim 2, wherein said housing comprises a floor, a peripheral wall extending about said floor and a cover hingedly connected to said peripheral wall for movement between a closed configuration and an open configuration.

4. A connector according to claim 3, wherein said inlet means extends through said peripheral wall.

5. A connector according to claim 4, wherein said retaining and piercing means comprises a plurality of discrete spaced apart channels fixed in said path between said entry and exit ports, at least first and second channels of said plurality being adapted to receive individual insulated conductors of the power line.

6. A connector according to claim 5, wherein said retaining and piercing means further comprises an insulation piercing member of metal fixedly mounted in each of said first and second channels, each piercing member being in electrical contact with one of said electrical connection elements.

7. A connector according to claim 6, further including depressing means on an interior face of said cover adapted to urge the isolated, insulated conductors into said first and second channels on closure of said cover such that the piercing members pierce the insulation of the conductors to electrically connect the piercing members with the conductive cores of the conductors in said first and second channels.

8. A connector according to claim 3, further including an elongate deformable latch on an outer free edge of said cover, and an elongate catch in said peripheral wall, said latch being deformed against said peripheral wall during closure of said cover and engaged by said catch in the closed configuration.

9. A connector according to claim 3, wherein said panel engaging means comprises a pair of spaced apart, planar flanges in opposed relationship defining a slot to receive an edge of an electrical heating panel.

10. A connector according to claim 9, wherein said planar flanges are spaced apart to engage opposed surfaces of the panel adjacent the said edge, with the said edge abutting a portion of said peripheral wall between said flanges.

11. A connector according to claim 10, wherein said inlet means extends through said portion of said peripheral wall between said flanges.

12. A connector according to claim 5, wherein said discrete spaced apart channels comprise a third channel adapted to receive a ground of the power line.

13. A connection according to claim 7, wherein said depressing means comprise elongate ribs projecting from said interior face and adapted to be received in said channels in said closed configuration.

14. A heating panel assembly comprising:

a generally planar panel having opposed planar major surfaces, bounded by an edge surface, an electrical resistance heating wire embedded within said panel between said major surfaces and first and second leads electrically connected with said heating wire and extending from said edge surface, an electrical connector comprising an electrically insulative housing and panel engaging means extending outwardly from said housing, said connector being mounted to said panel at said engaging means, inlet means in said housing, said leads of said panel projecting through said inlet means into said housing, entry and exit ports in said housing for passage of a multiple conductor power line therethrough, retaining and piercing means in said housing to electrically isolate individual insulated conductors of the power line in a path between said entry and exit ports, and including electrically conductive piercing members adapted to pierce the insulation of the isolated conductors to effect electrical contact between respective piercing members and conductors, said piercing members being electrically isolated from each other, and said first and second leads being electrically connected to said piercing members.

15. An assembly according to claim 14, further including first and second electrical connector elements in said housing, said elements being electrically isolated from each other, each of said first and second elements being electrically connected with one of said piercing members, said first lead being electrically connected to said first element and said second lead being electrically connected to said second element.

16. As assembly according to claim 15, wherein said panel engaging means comprise a pair of spaced apart planar flanges in opposed relationship, said flanges and said housing defining a slot receiving an edge portion of said panel with said flanges engaging said opposed planar surfaces, and securing means attaching said flanges to said panel.

17. An assembly according to claim 16, wherein said housing comprises a floor, a peripheral wall extending above said floor and a cover hingedly connected to said peripheral wall for movement between a closed configuration and an open configuration.

18. An assembly according to claim 17, wherein said inlet means extends through a portion of said peripheral wall between said flanges.

19. An assembly according to claim 18, wherein said retaining and piercing means comprises a plurality of discrete spaced apart channels fixed in said path between said entry and exit ports, at least first and second channels of said plurality being adapted to receive individual insulated conductors of the power line.

20. An assembly according to claim 19, wherein said retaining and piercing means further comprises an insulation piercing member of metal fixedly mounted in each of said first and second channels, each piercing member being in electrical contact with one of said electrical connection elements.

21. An assembly according to claim 20, further including depressing means on an interior face of said cover adapted to urge the isolated, insulated conductors into said first and second channels on closure of said cover such that the piercing members pierce the insulation of the conductors to electrically connect the piercing members with the conductive cores of the conductors in said first and second channels.

22. An assembly according to claim 17, further including an elongate deformable latch on an outer free edge of said cover, and an elongate catch in said peripheral wall, said latch being deformed against said peripheral wall during closure of said cover and engaged by said catch in the closed configuration.

23. An assembly according to claim 19, wherein said discrete spaced apart channels comprise a third channel adapted to receive a ground of the power line.

24. An assembly according to claim 21, wherein said depressing means comprise elongate ribs projecting from said interior face and adapted to be received in said channels in said closed configuration.

25. A method of installing a heating panel comprising:

providing an assembly as defined in claim 14, removing an outer sheath of a multiple conductor power line along a short length of the line to expose individual insulated conductors, disposing the short length within said housing between said ports and guiding said individual insulated conductors into said retaining and piercing means, to isolate said individual insulated conductors, and piercing the insulation of the insulated conductors to effect an electrical connection between the conductive cores of said isolated conductors and said first and second electrical connection elements, and including securing said assembly in a ceiling framework.

* * * * *